US005109891A

United States Patent [19]

Maina

[11] Patent Number: 5,109,891

[45] Date of Patent: May 5, 1992

[54] WEFT FEEDER FOR FLUID JET LOOMS WITH PNEUMATIC RETHREADING APPARATUS

[75] Inventor: Bruno Maina, Valdengo, Italy

[73] Assignee: ROJ Electrotex S.p.A., Biella, Italy

[21] Appl. No.: 588,925

[22] Filed: Sep. 27, 1990

[30] Foreign Application Priority Data

Sep. 27, 1989 [IT] Italy ..... 21846 A/89

[51] Int. Cl.[5] ..... D03D 47/34

[52] U.S. Cl. ..... 139/450; 139/452; 139/116.2; 139/435.4

[58] Field of Search ..... 28/203; 139/450, 452, 139/116.2, 435.4

[56] References Cited

U.S. PATENT DOCUMENTS

| | | | |
|---|---|---|---|
| 4,658,866 | 4/1987 | Takegawa . | |
| 4,832,091 | 5/1989 | Shaw . | |
| 4,916,784 | 4/1990 | Tachibana et al. . | |
| 4,951,718 | 8/1990 | Shaw | 139/450 |
| 4,989,644 | 2/1991 | Tanaka et al. | 139/435.4 X |

FOREIGN PATENT DOCUMENTS

WO89/02944 4/1989 World Int. Prop. O. .

*Primary Examiner*—Andrew M. Falik

*Attorney, Agent, or Firm*—Young & Thompson

[57] ABSTRACT

In a measuring weft feeder for fluid jet looms, the continuity of the weft yarn from the feed spool or reel to the main nozzle of the loom is automatically restored by two compressed air devices acting on the weft yarn, the first of which—positioned at the inlet of the weft feeder, to withdraw therefrom the broken yarn and introduce therein new yarn fed by the spool or reel—comprises a first duct connected to the inlet of the weft feeder, along which duct there are positioned a clamp, a nozzle and a cutter. A second duct branches off from the first, close to its outlet into the weft feeder, which also comprises a nozzle, while the second device—positioned adjacent to the weft feeder drum, to receive the new yarn fed by the first device and by the winding arm and send it to a fixed point for feeding the main nozzle of the loom—comprises a curved profiled duct, which is either open or adapted to open longitudinally towards the drum and has an aerodynamic guide for the yarn. A third compressed air device can also be provided, to act on the weft yarn is sent from the second device so as to facilitate its feeding into the main loom nozzle, this third device also comprising a duct wherein acts a nozzle as well as an air outlet.

12 Claims, 11 Drawing Sheets

WEFT FEEDER FOR FLUID JET LOOMS WITH PNEUMATIC RETHREADING APPARATUS

BACKGROUND OF THE INVENTION

The present invention concerns improvements in weft feeders for fluid jet looms. More precisely, the object of the invention is to automatically restore in such feeders the continuity of the weft yarn from the spool to the loom, in case of yarn breakage or interruption.

As known to the skilled in the art, in a fluid jet loom (particularly an air loom) the arrangement usually adopted for weft yarn feeding is that shown in the diagram of FIG. 1 of the accompanying drawings. The weft yarn 4 is drawn from a stationary spool or reel 1—through one or more guide eyelets—by the weft feeder 2. It is also known that said feeder essentially comprises an electric motor 5, which causes the rotation of a winding arm 6, and a drum 8, held stationary, onto which the arm 6 winds up the yarn into even turns, forming a certain amount of weft yarn reserve detected by sensors 7. The main loom nozzle 3, provided to launch the weft yarn into the warp shed, draws from the drum 8 of the feeder 2 the weft yarn length required for each weft insertion, which length is measured by the feeder counting the number of unwound turns, for instance by means of photoelectric cells 9. One or more electromagnetic stopping devices 19 block in known manner the yarn 4 on the drum of the weft feeder 2, stopping loom feed, as soon as the weft yarn let out from the weft feeder and launched into the shed has reached the predetermined length.

The absence of weft yarn, due to running out of the spool or reel 1, or to yarn breakage somewhere along its path, is detected and signalled by suitably positioned sensors, as 7 and 9.

Weft yarn interruption generally requires the intervention of an operator, so that the yarn may be recovered from the reel 1 and introduced by hand into the various guide members, as far as the main loom nozzle 3; it is a rather long and tiresome operation, having to be carried out while the loom is not working, with consequences from the productive point of view which need not be illustrated. It is therefore evident that loom users are highly interested in disposing of systems allowing the automatic insertion and/or re-insertion of the weft yarn in loom feeding.

The designers of weft feeders have long been faced with this problem, which is at present most felt.

It should be said that there are already known to be various methods and devices allowing to reach this object by using mechanical or pneumatic means (those described in EP-0 216 220 are cited as a general example), but all such devices are quite complicated, fairly bulky and subject to the risk of faults.

Systems have also been proposed, which provide for a change of the reel and for the use of a knotter, as in EP-0 269 140; but this system is able to repair the interruption only if it occurs upstream of the weft feeder, or as the yarn reaches the weft feeder drum; furthermore, due to the difficulty in finding the broken yarn end and pulling it correctly to the side of the new yarn end, the knot sometimes fails to tie or often does not turn out well, which can cause further faults in the fabric being woven on the loom. It is thus evident that the problem needs to be solved with simpler and far safer means, which should moreover be integrated as far as possible with the feeder itself.

SUMMARY OF THE INVENTION

The present invention supplies a solution of this type, in that it concerns a weft feeder for fluid jet looms having a main nozzle and secondary nozzles for weft insertion, particularly air looms, of the type also measuring the weft yarn lengths being fed (measuring weft feeder) and comprising a drum held stationary, onto which a winding arm winds up a weft yarn reserve, and means to automatically restore the continuity of the yarn from the feed spool or reel to the main nozzle of the loom, characterized in that, said means consist of at least two compressed air devices acting on the weft yarn, the first of which—positioned at the inlet of the weft feeder, to withdraw therefrom the broken yarn and introduce therein new yarn fed by the spool or reel—comprises a first duct connected to the inlet of the weft feeder, along which duct there are positioned clamping means, nozzle means and cutting means, and a second duct branching off from the first, close to its outlet into the weft feeder, which also has nozzle means, while the second device—positioned adjacent to the weft feeder drum, to receive the new yarn fed by the first device and by the winding arm and send it to a fixed point for feeding the main nozzle of the loom—comprises a curved profiled duct, which is either open or adapted to open longitudinally towards the drum and has aerodynamic guide means for the yarn.

The weft feeder preferably comprises a third compressed air device acting on the weft yarn sent from the second device—positioned upstream of the main nozzle of the loom being fed and suitably aligned therewith, so as to feed the yarn into said nozzle—which comprises a duct wherein act nozzle means, followed by air outlet means. The third device can eventually also be equipped with clamping means.

Furthermore, the first duct of the first device of the weft feeder suitably forks into two branches to allow feeding the weft feeder from two spools or reels.

The duct of the second device of the weft feeder preferably opens towards the drum and comprises aerodynamic guide means for the yarn. Furthermore, nozzle means can be associated with said duct, for yarn guiding and drawing purposes.

A pre-nozzle can moreover be provided between the third compressed air device and the main nozzle of the loom to be fed.

The invention also concerns the method—carried out with the weft feeder specified heretofore—to automatically restore the continuity of the weft yarn fed from the spool or reel to the main nozzle of a fluid jet loom, through a measuring weft feeder. The method is essentially characterized by the following steps: after having detected weft yarn breakage by means of sensors and stopped the loom, the broker yarn is totally removed by means of a first compressed air device positioned upstream of the weft feeder; a new weft yarn is then inserted in the weft feeder; the new yarn is launched by means of a second compressed air device to a fixed point from which the main nozzle of the loom is fed; the new weft yarn is blocked on the weft feeder and is wound on the drum, forming again a reserve; the weft yarn is then inserted into the main nozzle and the loom is started again.

According to a different important embodiment of the method, the main nozzle of the loom is fed with the new yarn launched by said second device through a third compressed air device, positioned downstream of the weft feeder, in which the yarn is received, is cut to size and its new end is launched to the main nozzle.

BRIEF DESCRIPTION OF THE DRAWINGS

The invention is now described in further detail, with reference to some preferred embodiments thereof, illustrated on the accompanying drawings, in which:

FIGS. 4 and 5 are cross section views of a first embodiment of the duct forming said second device, of which

DESCRIPTION OF THE PREFERRED EMBODIMENTS

Figure 1:
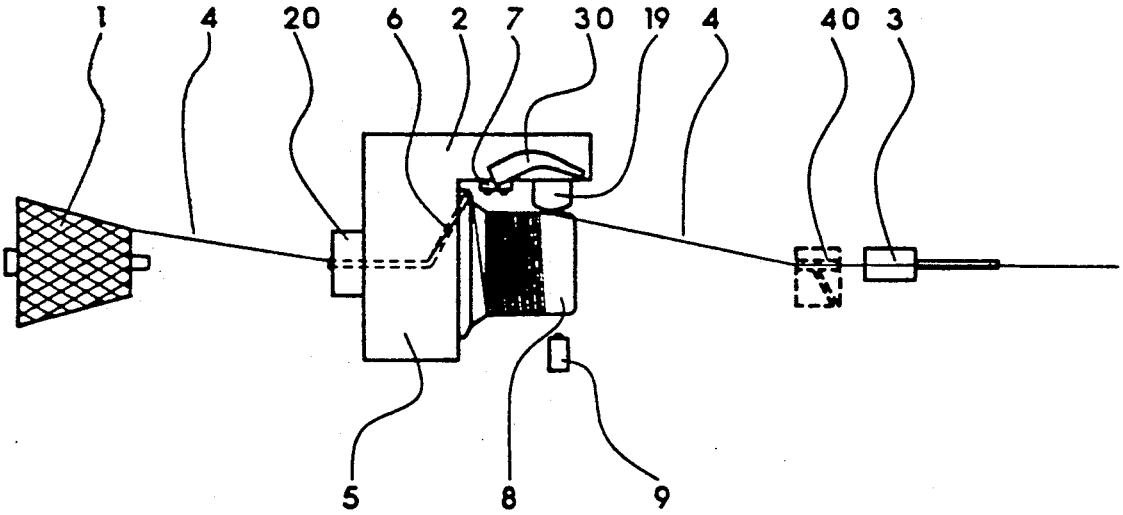
FIG. 1 shows, as already explained, an elevational view of the general feeding arrangement of an air loom.

With reference to the accompanying drawings, it should first of all be premised that, in the arrangement of FIG. 1, the lack of yarn due to running out of the reel 1, is equivalent to a breakage of yarn 4 at the inlet into the weft feeder 2. On the other hand, breakages can take place upstream of, along, or downstream of the weft feeder 2: more generally, the interruption occurs on the weft feeder drum, leaving apart two distinct yarn ends, a first end connected to the reel 1 and the other end connected to the nozzle 3.

According to the invention:

- the first yarn end, still wound around the drum, is removed by being sucked back and unwound from the drum by reverse rotation of the winding arm;
- the second yarn end is removed by blowing away, through the main loom nozzle, the yarn turns left on the drum at its outlet towards the loom;
- new yarn is then inserted into the weft feeder, starting from the same spool or reel, or from a spare reel.

Figure 2:
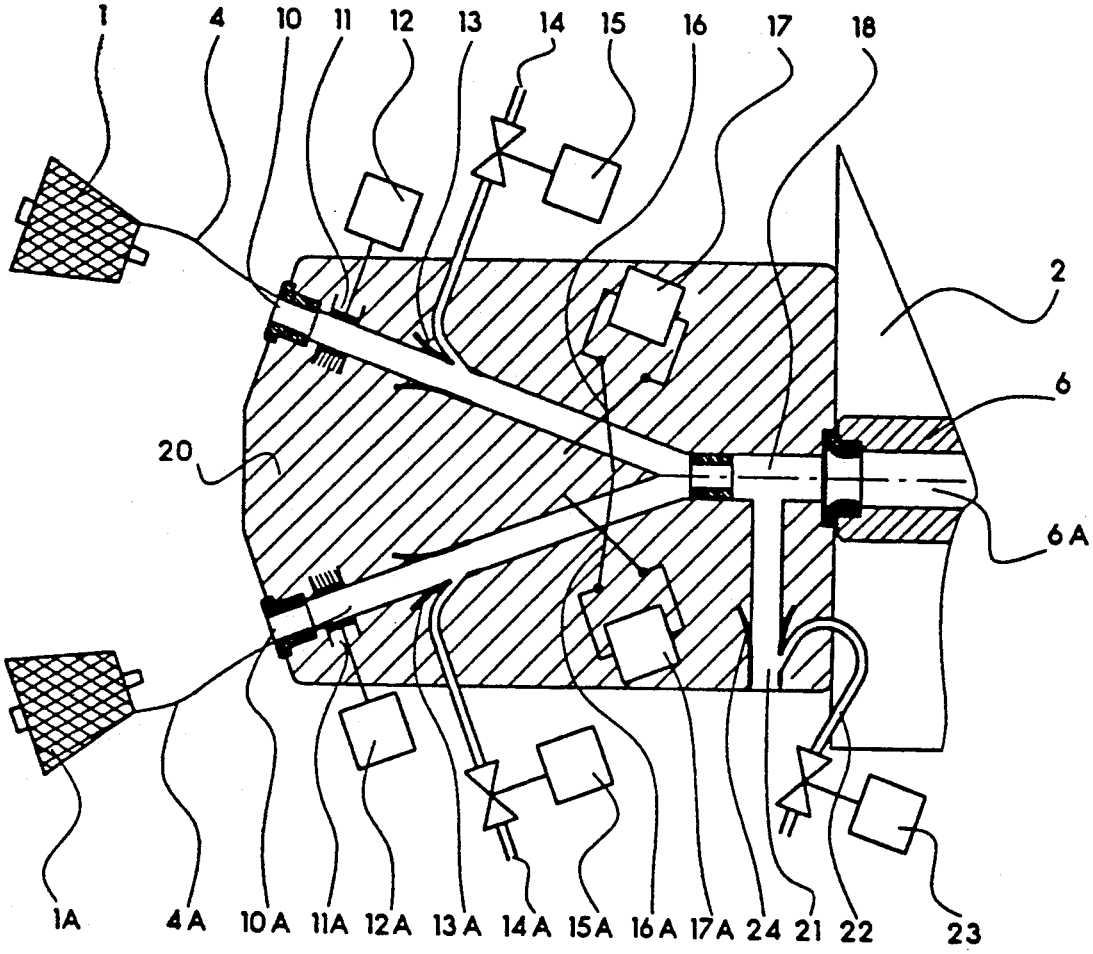
FIG. 2 shows a cross-sectional top plan view of the first compressed air device applied to the weft feeder for the objects of the invention.

To carry out this method, the invention provides to equip the feeder with two or three compressed air (or pneumatic) devices. Thus, the pneumatic device 20—shown in FIG. 2—is first of all applied at the inlet of the feeder 2: this is a body crossed by two convergent ducts 10 and 10A, into which are inserted weft yarns 4 and 4A, fed respectively by the reels 1 and 1A. The two convergent ducts 10 and 10A join into a single duct 18 of the body 20, which is positioned in correspondence of the cavity 6A of the winding arm 6 of the weft feeder 2.

Along ducts 10 and 10A there are positioned, starting from the inlet hole:

- grippers 11, 11A, to clamp the weft yarns 4 and respectively 4A, controlled by electromechanical or electropneumatic actuators 12 and respectively 12A;
- pneumatic nozzles 13, 13A, fed with compressed air through pipes 14, 14A, thanks to the action of solenoid valves 15, 15A, so as to launch the weft yarn towards the inlet of the weft feeder, in correspondence of the cavity 6A of the winding arm 6;
- shears or cutters 16, 16A, to cut the yarns, controlled by actuators 17 and respectively 17A.

Furthermore, a duct 21 branches off from the duct 18. The duct 21 communicates with the exterior and ends with a nozzle 24, into which compressed air can be let from a duct 22 by opening a solenoid valve 23, so as to produce a suction pressure and suck the weft yarn out of the duct 18, removing it.

Figure 3:
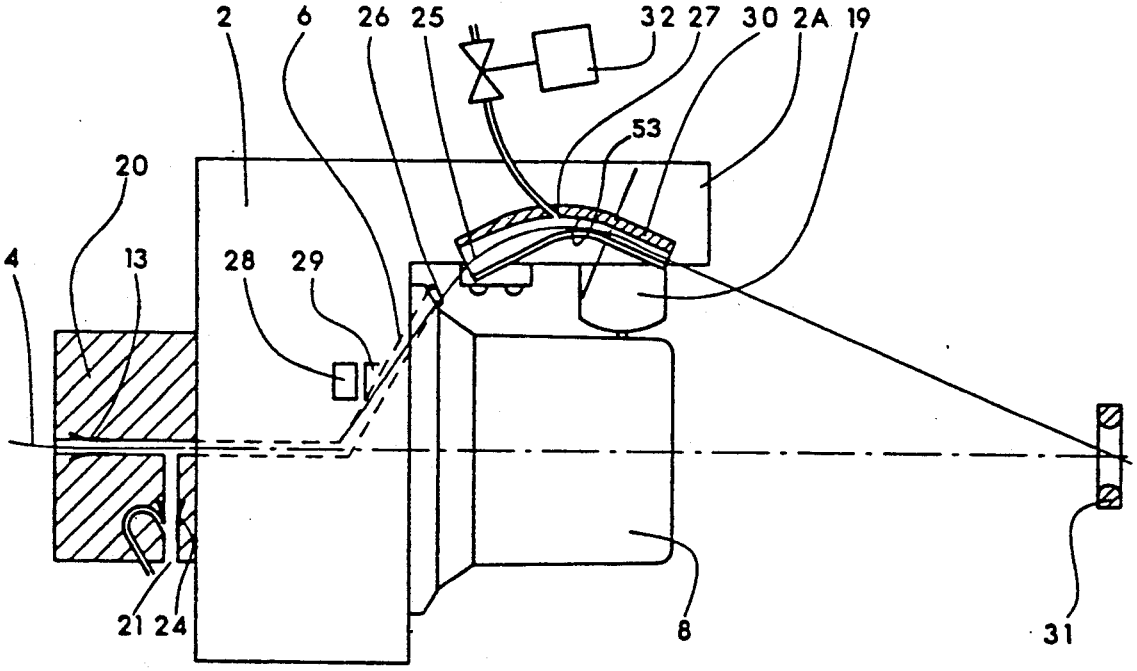
FIG. 3 shows an elevational view of the weft feeder according to the invention, to which there is applied the compressed air device of FIG. 2 and the second compressed air device of the invention.

According to the invention, a second pneumatic device 30 is applied on the weft feeder to the side of its yarn reserve winding drum. The device—of which FIG. 3 shows a longitudinal section view—comprises a fixed duct 25, positioned along the projection 2A of the weft feeder 2: this is a curved and suitably profiled duct, meant to guide the yarn 4 coming from the inner cavity of the winding arm 6 towards a fixed point from which the main nozzle of the loom is fed. In FIG. 3, the fixed point is the yarn guide eyelet 31, positioned outwardly along the axis of the weft feeder; the eyelet 31 could also be the inlet of the main nozzle 3 of the loom, or the inlet to a third (auxiliary) pneumatic device 40, described hereinafter.

The outlet 26 of the inner cavity of the winding arm 6 (FIG. 3) should face the inlet of the fixed duct 25, so that air and yarn may be sent into this latter with practically no pressure and speed losses; means are hence provided to stop the winding arm 6 in the exact corresponding angular position: these can consist of a permanent magnet 29, positioned on the winding arm, and of an induction switch 28.

Compressed air can be blown into the duct 25 of the device 30 (FIG. 3) from a nozzle 27 controlled by a solenoid valve 32, and emerging along the intrados of the outer wall 53 of the duct 25, in order to draw the yarn 4 (thereby increasing the pressure on the yarn, help it to reach the eyelet 31).

Figure 4:
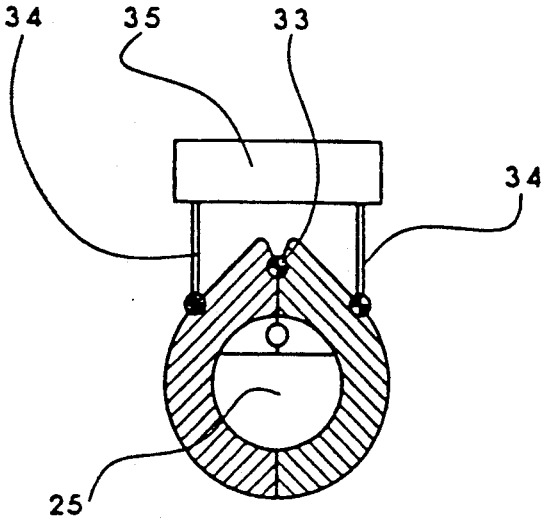
Figure 5:
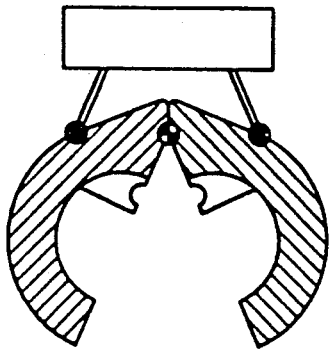
Figure 6:
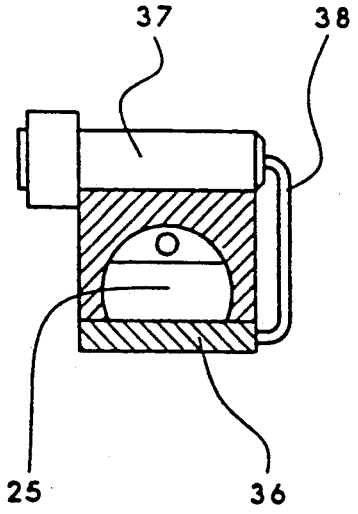
FIGS. 6 and 7 show cross sections of an alternative embodiment.
Figure 7:
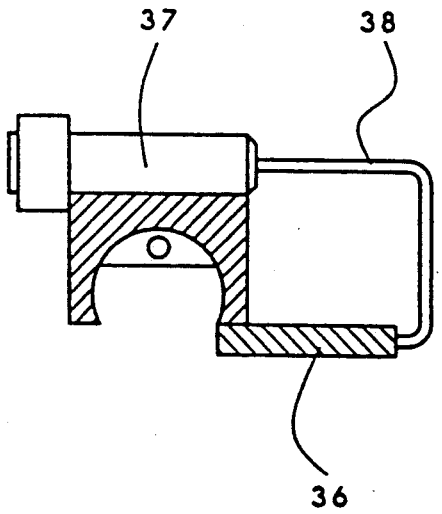

Once the yarn 4 is inserted into the duct 25, it should be left free to wind around the surface of the drum 8: the duct should hence be open or adapted to open downwards. By way of example, FIGS. 4 and 5 show the cross section of a device 30 with the duct 25 in a closed and, respectively, open position; the duct is divided in two halves, mutually connected by a hinge 33 and adapted to open apart, like two jaws, under the action of levers 34 controlled by a pneumatic or electromechanical actuator 35. Alternatively, FIGS. 6 and 7 show the cross section of a duct 25 of the device 30, the walls of which can be provided with a movable bottom 36, which can be removed by an actuator 37 by means of arms 38.

Figure 8:
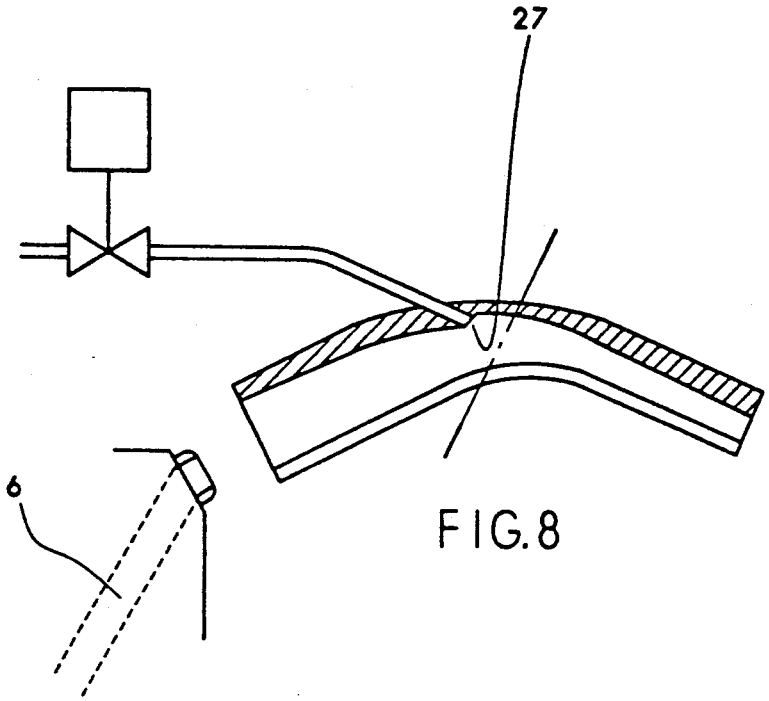
FIGS. 8 and 9 are, respectively, a longitudinal and a cross section view of an open embodiment of the above duct.
Figure 9:
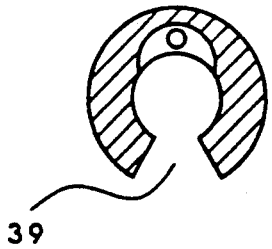

Whereas, FIGS. 8 and 9 are a longitudinal and, respectively, a cross section view of a device 30 with an open duct 25, which has a longitudinal groove 39 opening towards the weft feeder drum 8.

In the devices of FIGS. 3 to 8, the compressed air jet blown from the nozzle 27 must be suitably guided towards the outlet end of the duct 25.

Figure 10:
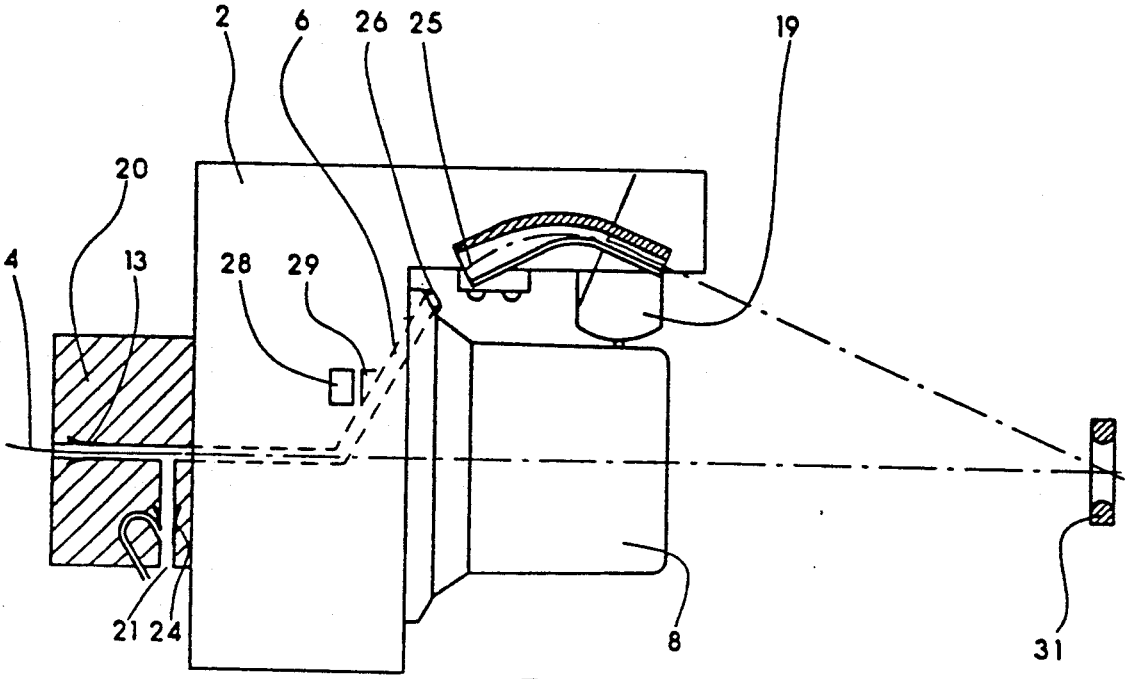
FIGS. 10 to 14 show views similar to those of FIGS. 8 and 9, of other embodiments of the second device applied to the weft feeder.
Figure 11:
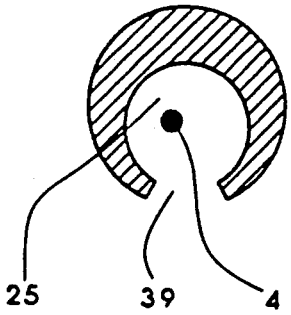

As shown in the embodiments of FIGS. 10 and 11, the duct 25 of the device 30 can also be without the nozzle 27; this is possible when the air jet blown from the inlet nozzle 13 is sufficient to allow the yarn 4 to reach the eyelet 31 (FIG. 10). The duct 25 of the device 30 shown in FIG. 10 is of the open type, that is, having an opening 39 from which the yarn 4 can come out (as shown in the cross section view of FIG. 11).

Figure 12:
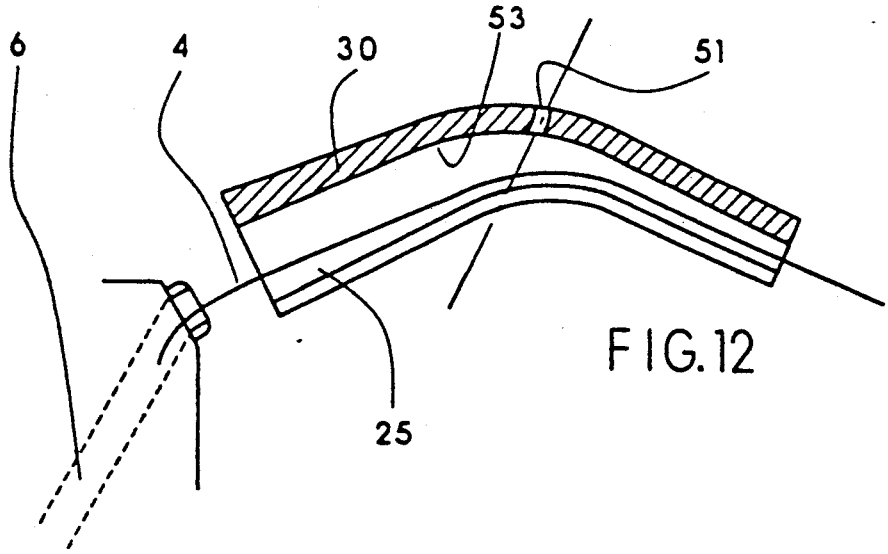
Figure 13:
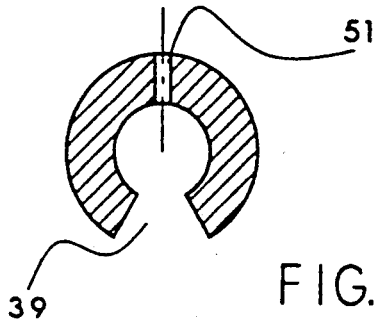
Figure 14:
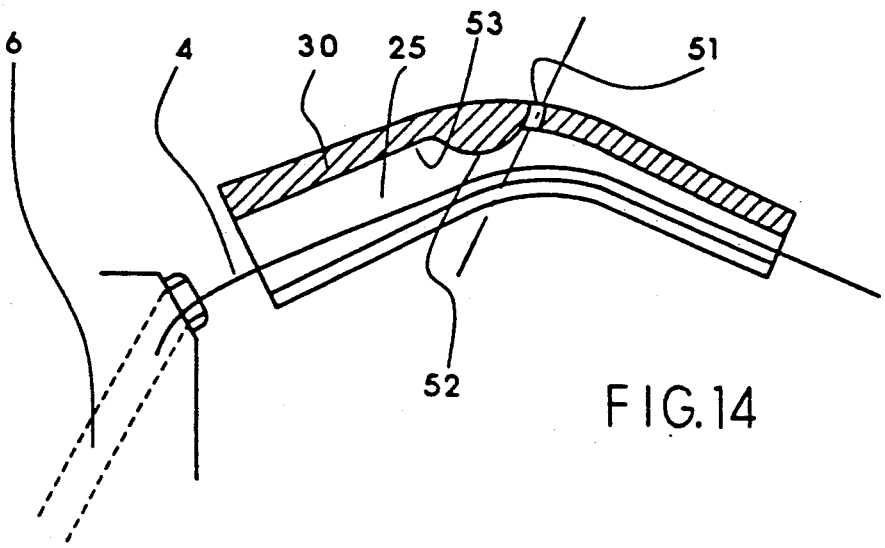

Other embodiments of the device 30 with an open duct 25 and without the auxiliary nozzle, are shown in FIGS. 12 to 14. In FIGS. 12 and 13 (a longitudinal and a cross section view of the duct 25), one or more vents 51 are formed on the outer wall 53 of the duct 25, so as to keep the yarn adherent to said wall 53; while in FIG. 14, a protuberance 52, followed by one or more vents 51, is formed inside the outer wall 53 of the duct 25, having the effect to create a depression adapted to push the yarn 4—with the help of the centrifugal force—against said wall 53, during launching thereof. Thus, the curved profiled duct 25 opens longitudinally toward the drum, and aerodynamic guide means in the duct are provided by protuberance 52 formed in the intrados of the outer wall of the duct, formed by vent 51 in the same wall.

As shown in FIGS. 3 and 10, the object of the aforedescribed device 30—whether it essentially performs guiding functions, or whether these are combined with yarn drawing functions—is to insert the yarn 4 into the yarnguide eyelet 31.

If the suction power at the inlet of the main loom nozzle 3 is sufficient to pick the yarn, this latter can reach the nozzle 3 directly from the duct 25, so that the continuity of the weft yarn is restored when the feeding line is in the condition shown in continuous lines in FIG. 1.

When, viceversa, the suction power at the inlet of the nozzle 3 is scarce or inexistent, the arrangement according to the invention has to be completed by providing, upstream of the nozzle 3 and suitably aligned therewith, an auxiliary device 40 (shown in FIGS. 15 to 17 and—in dashed lines—in FIG. 1) adapted to receive the yarn sent from the duct 25 of the device 30 and to insert it into the main nozzle 3.

Figure 15:
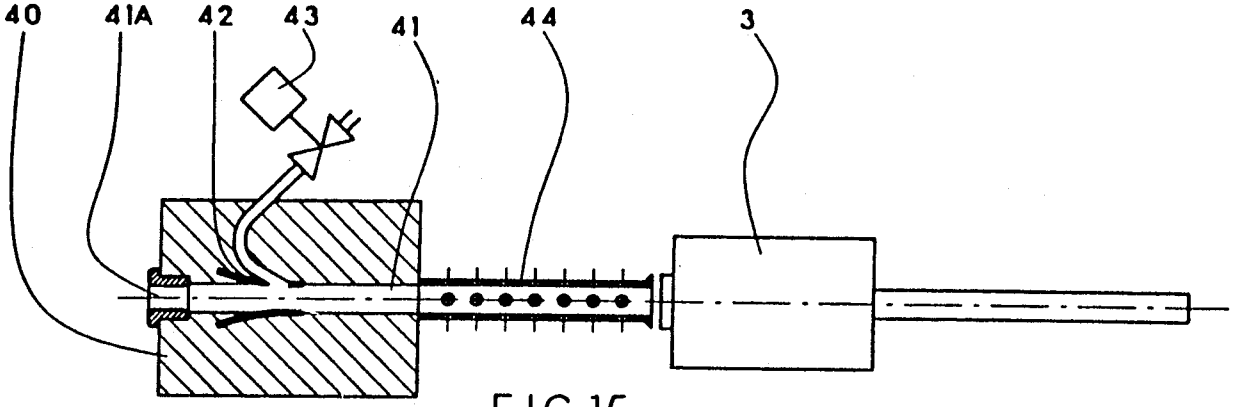
FIGS. 15 to 17 show in cross section three embodiments of the third compressed air device to be eventually associated to the weft feeder according to the invention.

This third pneumatic device is similar to the device 20, with only one inlet, shown in FIG. 3; it comprises—in the simpler embodiment of FIG. 15—a duct 41 with inlet 41A, along which a nozzle 42 fed with compressed air from a solenoid valve 43 produces a depression sufficient to suck the yarn 4 sent from the duct 25 and launch it directly into the main loom nozzle 3, crossing a tube 44 which connects the device 40 to said nozzle 3. The tube 44 has radial holes allowing to gradually reduce the jet of air by blowing it outwardly.

The use of a device as that shown in FIG. 15 presupposes the loom to be equipped with means for removing the superfluous yarn launched through the warp shed by the nozzle 3, with the loom at a stop, in the final step of restoring yarn continuity in the weft feeding line.

If, on the contrary, the loom is not prearranged for this operation, the device 40 has to be equipped with a lateral duct to remove the yarn in excess, before the loom is fed.

Figure 16:
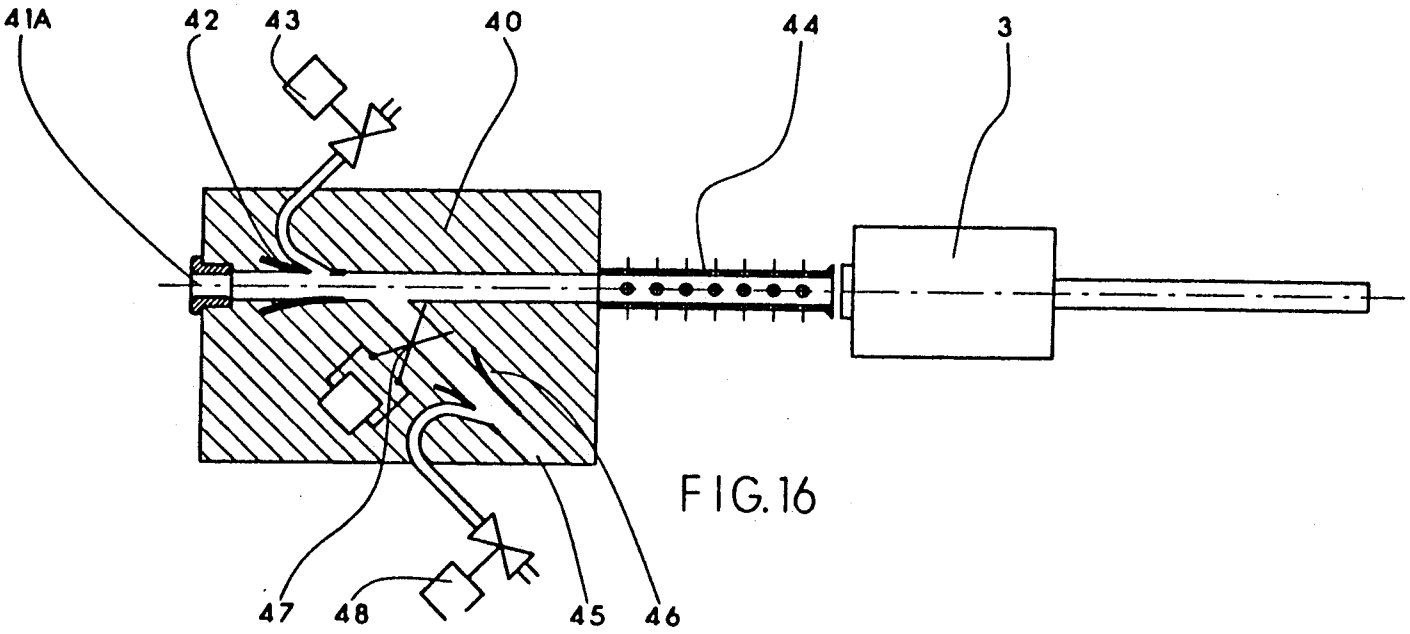

The embodiment illustrated in FIG. 16 includes this duct, indicated by reference 45. In said duct operates a cutter or shear 47 which, besides cutting the yarn 4 in excess, also has the function to open and close the duct 45. This duct also comprises a nozzle 46, fed with compressed air from a solenoid valve 48.

Figure 17:
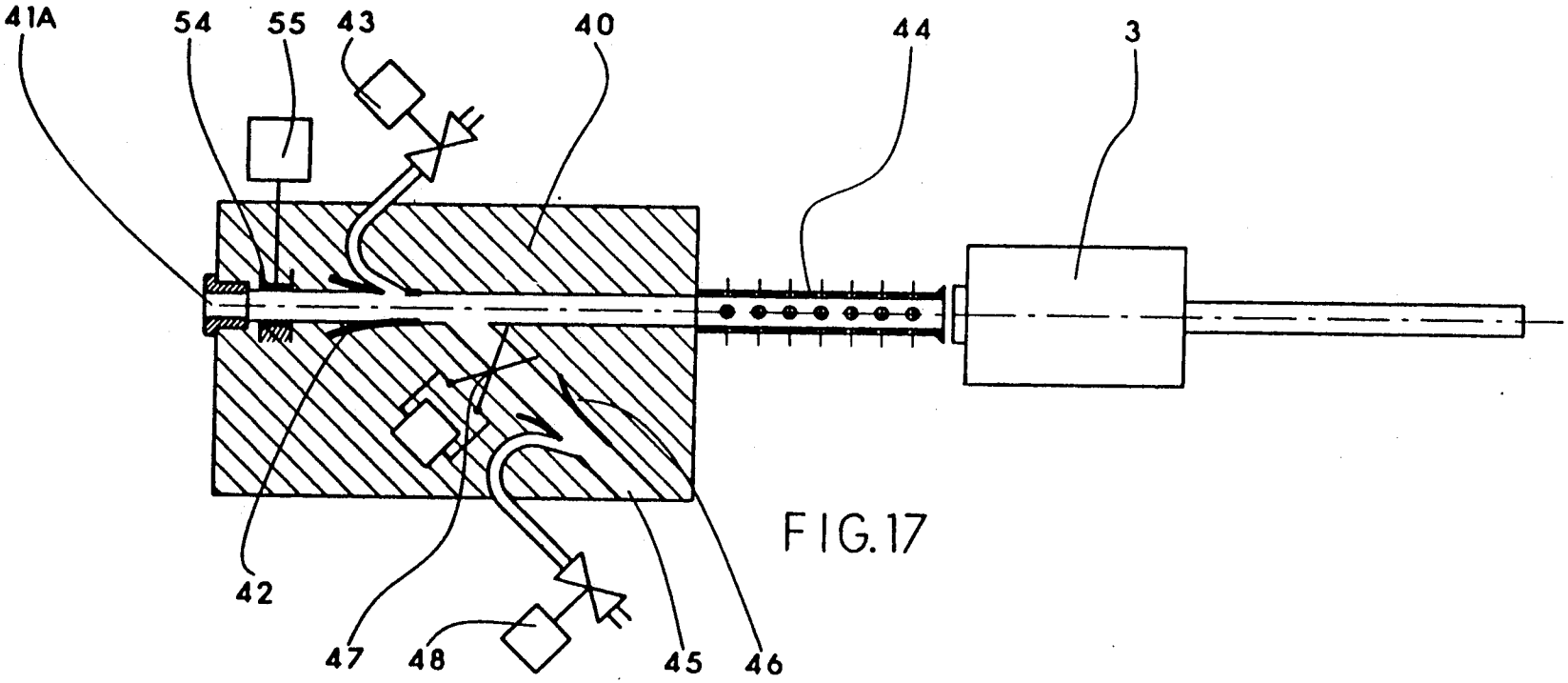

FIG. 17 shows a device 40 similar to that of FIG. 16, but completed with yarn clamping means 54 controlled by an actuator 55.

Figure 18:
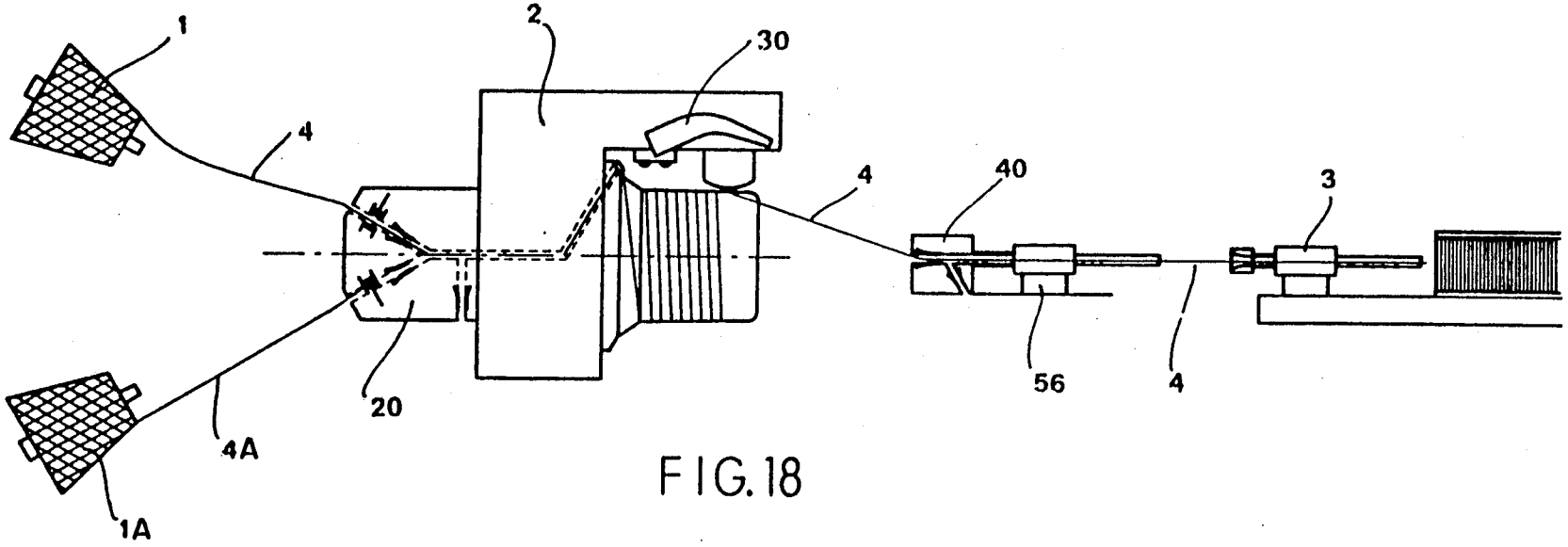
FIG. 18 shows a particularly complete plan view of a currently preferred embodiment of the whole arrangement according to the invention.
Figure 19:
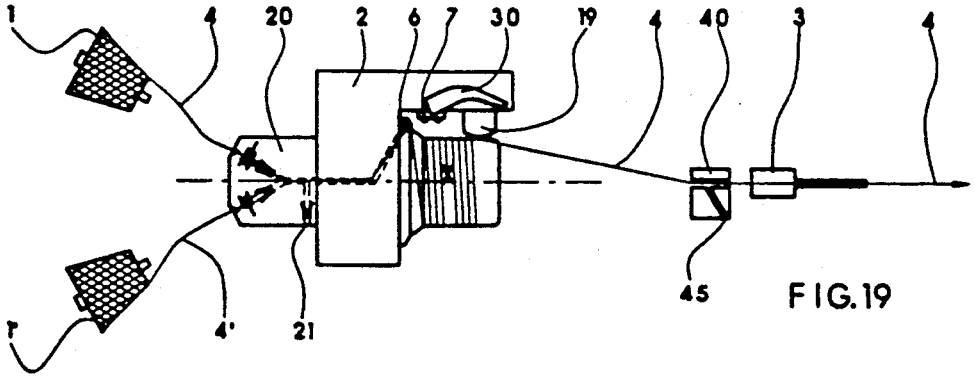
FIGS. 19 to 22 are diagrams similar to FIG. 18, showing the working of the weft feeder according to the invention, in order to restore the continuity of the weft yarn to be fed to the loom.

A particularly complete and currently preferred embodiment of the arrangement according to the invention is shown in FIG. 18, which illustrates the feeder 2 fed by reels 1, 1A, and equipped with compressed air devices 20, 30 and 40, according to the invention. The device 40, instead of being associated directly to the main loom nozzle, is associated to a pre-nozzle 56 which guides the yarn 4 into the main nozzle 3 of the loom being fed.

The working of the weft feeder according to the invention shall now be described, considering first of all the case of weft yarn breakage on the weft feeder drum 8. After a sensor has detected yarn breakage, causing the stopping of the loom and of the weft feeder, the following operations take place in succession:

- the gripper 11 of the device 20 (FIG. 2) closes, clamping and blocking the weft yarn 4 fed from the reel 1;
- the nozzle 24, is operated by letting in air through the duct 22, to remove the weft yarn, whereby the yarn 4 downstream of the gripper 11 is sucked into the duct 21, while the winding arm 6, rotating counterclockwise, unwinds the yarn turns from the drum 8;
- once the yarn has been removed, under control of a sensor 7—or simply, after an appropriate number of counterclockwise rotations of the winding arm 6, exceeding the maximum number of turns which can be wound on the drum 8—the shears 16 cut the yarn, thereby causing its full removal through the duct 21;
- at this point, the nozzle 13 is actuated and the gripper 11 is simultaneously opened, so as to launch and re-insert the weft yarn 4 into the cavity 6A of the winding arm 6.

Viceversa, if yarn breakage has occurred on the reel 1, the yarn 4 no longer reaches the duct 10, nor the cavity of the winding arm 6. The sensor 7 detects that the breakage has occurred on the reel, in that the drum 8 is no longer fed with yarn.

In this case, the re-insertion is done with the yarn 4A fed from the reel 1A, provided that the yarn end on the reel 1A has been previously inserted into the duct 10A and blocked in position by the gripper 11A.

The operation of the pneumatic nozzle 13A and the simultaneous opening of the gripper 11A cause the yarn 4A to be launched and inserted into the cavity of the winding arm 6.

In this way, the constant feeding of weft yarn is obtained by switching onto a new reel, without any protracted stops of the loom, nor any interventions of the operator.

The previously described device 20 (FIG. 2), at the inlet of the weft feeder, can be simplified by being formed with a single duct for weft yarn insertion. The working of this simplified device is similar to that described for the device with two ducts (10, 10A); nevertheless, in this case, there is no possibility of automatic re-insertion in the event of yarn breakage on the reel.

Of course, each feeding reel 1, 1A, can be connected to a supplementary reel by the known "nose-to-tail" system, which provides the advantage of yarn continuity when the first reels run out of yarn.

Thanks to the action of the aforedescribed device 20, the free end of the yarn 4, which has been re-inserted, emerges from the cavity of the winding arm 6 of the weft feeder and is drawn by the device 30 (FIG. 3).

The re-inserted yarn then moves forward into the fixed duct 25 of said device 30—thanks to the air blown by the nozzle 27 and/or to the different means provided therein and already described—and is launched towards the eyelet 31. If this latter coincides with the inlet to the main loom nozzle, the re-insertion takes place and the loom is started again.

If, viceversa, use is made of an auxiliary device 40 upstream of the main loom nozzle (FIGS. 15 to 17), the yarn launched by the device 30 reaches the inlet 41A of the duct 41 of said device and is drawn and launched towards the main nozzle 3 by actuating the solenoid valve 43. In the arrangement of FIG. 16, the duct 45 where the cutter 47 is positioned, is initially open; the nozzle 46 is fed with compressed air from the solenoid valve 48, producing in the duct 41 the suction required to draw the yarn sent from the weft feeder and remove it through the outlet of the duct 45.

The cutter 47 is then operated, cutting the yarn and simultaneously closing the duct 45. The nozzle 42 acts on the duct 41 by actuating the solenoid valve 43 and the yarn, already inserted into 41A, is launched through a perforated connection tube 44 and is inserted into the main nozzle 3 of the loom.

The device 40 of FIG. 17, equipped with clamping means 54, allows to exactly measure the weft yarn length which has to be launched into the main loom nozzle before starting the loom, so that the free end of the weft yarn having to be inserted into the shed may reach exactly the inlet of the shed itself.

In fact, in this embodiment of the device 40, the clamping means 54 block the weft yarn soon after it has been launched into the duct 45, after which the yarn is cut by the cutter 47.

In this condition, the winding arm 6 of the weft feeder 2 can be caused to perform a rotation such as to wind on the drum 8 a yarn length equal to the distance between the yarn end which has just been cut and the inlet of the loom shed.

After having stopped the winding arm 6 and operated the clamping means 11, 11A, of the device 20, one disconnects the electromagnetic stopping device 19 of the weft feeder 2 and opens the clamping means 54 of the device 40, and the nozzle 42 of said device 40 is then actuated through 43 thereby obtaining the feeding of the desired weft yarn length as far as the inlet of the loom shed.

At this point, the clamping means 54 are again operated, the clamping means 11, 11A are caused to open, and the usual yarn reserve is wound on the drum 8 to restore the normal working conditions.

The arrangement shown in FIG. 18 works in a similar way, if equipped with the device 40 of FIG. 17. It should be noted that, in this case, the weft yarn length to be measured has to take account of the presence of the pre-nozzle 56 and, thus, of the increased distance between the feeder 2 and the main loom nozzle 3.

Figure 20:
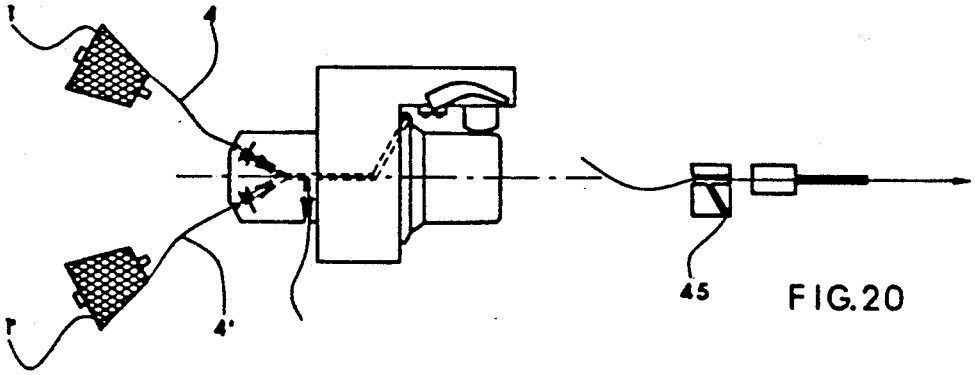
Figure 21:
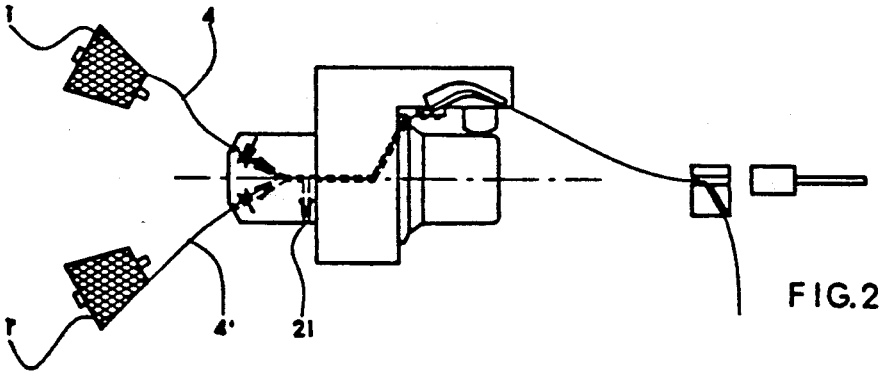

With reference to FIGS. 19 to 22, the method according to the invention for restoring the continuity of the weft yarn from the reel to the loom—in the more general case of weft yarn breakage being detected by the sensors 7 on the weft feeder drum—can be summed up in the following steps:

1—With the loom at a stop, the yarn 4 upstream of the breakage point X (FIG. 19) is unwound by reversing the rotation of the winding arm 6, and the yarn is removed through 21 by means of the device 20 positioned at the inlet of the weft feeder 2;

2—The yarn 4 downstream of the breakage point X is unwound by operating the nozzle 3 and blowing said yarn beyond the warp shed; in this way, the yarn 4 is totally removed from the weft feeder 2, which finds itself in the condition illustrated in FIG. 20;

3—The yarn 2 is cut with the cutter 16 and the cut end is blown towards the outlet of 21;

4—After opening the gripper 11, the yarn 4 fed by the reel 1 is blown by the nozzle 13 through the cavity of the winding arm 6 and into the duct 25 of the device 30; from this latter, the yarn 4 is blown into the auxiliary device 40, which sends it in turn into the lateral outlet duct 45: the situation is as illustrated in FIG. 21;

5—The yarn 4, kept stretched by the device 40, is lowered from the duct 25 onto the surface of the weft feeder drum 8 and is blocked by the electromagnetic stopping device 19;

6—The winding arm 6 starts to work, winding the yarn 4 on the drum 8 and forming again the reserve;

7—The yarn is finally recovered from the outlet duct 45 and deviated in the direction of the main nozzle 3, wherein the yarn end is inserted by the device 40.

Figure 22:
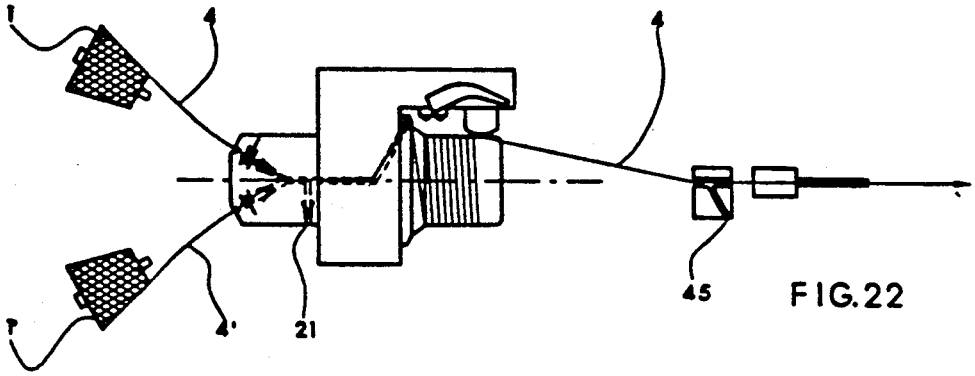

The situation shown in FIG. 22 is thus reached, whereby the continuity of the weft yarn is restored and the weft feeding line is ready for the loom to start working again.

This method includes modifications provided in particular cases, among which the important one of yarn breakage downstream of the weft feeder and the equally important one of yarn breakage upstream of the weft feeder.

In the first case, the whole yarn reserve is still wound on the drum 8, while, in correspondence of loom inlet, the yarn has usually already emerged from the device 40 and from the nozzle 3.

All the yarn turns are unwound and removed, as said, then proceeding in the same manner (operation 1).

In the second case, the sensors 7 detect that yarn is not emerging from the cavity of the winding arm 6 and signal the interruption, stopping the weft feeder 2; the loom can also be left working for a few beatings up, corresponding to the whole lengths of weft yarn still wound on the drum.

After stopping of the loom, the yarn left on the drum is unwound by means of the loom nozzle 3, as described heretofore (operation 2).

The outlet duct 21 need not be used (operation 1 and 3), but it is necessary to change the yarn—through the device 20—by switching over from the feeding reel 1 (yarn 4) to the spare feeding reel 1A (yarn 4A): this is obtained by opening the gripper 12A and actuating the nozzle 13A.

The yarn 4A is then launched (operation 4), while operations 5, 6 and 7 remain unvaried.

It is to be understood that other variants and modifications are possible according to the invention, both for what concerns the devices applied on the weft feeder and for what concerns the methods adopted for re-inserting the weft yarn; for instance, the duct 18 of the device 20 can be forked into more than two convergent ducts or branches, for feeding yarn from more than two reels. All such variants and modifications fall within the scope of the present invention.

I claim:

1. In a fluid jet loom having a weft feeder comprising a main nozzle and secondary nozzles for weft insertion, of the type also measuring the weft yarn lengths being fed and comprising a drum held stationary, onto which a winding arm winds up a weft yarn reserve, and means to automatically restore the continuity of the yarn from a feed spool to a main nozzle of the loom; the improvement in which said means consist of at least two compressed air devices acting on the weft yarn, the first device being positioned at an inlet of the weft feeder, to withdraw therefrom broken yarn and introduce therein new yarn fed by the spool and comprising a first duct connected to the inlet of the weft feeder, along which duct there are positioned clamping means, nozzle means and cutting means, and a second duct branching off from the first, close to an outlet of said first duct into the weft feeder, which second duct also has nozzle means; the second device being positioned adjacent to the weft feeder drum, to receive new yarn fed by the first device and by the winding arm and send it to a fixed point for feeding the main nozzle of the loom, and comprising a curved profiled duct, which is either open or includes means for opening longitudinally towards the drum and has aerodynamic guide means for the yarn.

2. Weft feeder as in claim 1, further comprising a third compressed air device acting on the weft yarn sent from the second device, said third device being positioned upstream of the main nozzle of the loom and aligned therewith, so as to feed the yarn into said main nozzle, and comprising a duct wherein act nozzle means, followed by air outlet means.

3. Weft feeder as in claim 2, wherein said third device is also equipped with clamping means.

4. Weft feeder as in claim 8, wherein a pre-nozzle is provided downstream of said third device.

5. Weft feeder as in claim 1, wherein the first duct of said first device forks into two branches to allow feeding the weft feeder from two spools or reels.

6. Weft feeder as in claim 1, wherein auxiliary nozzle means are associated to the curved profiled duct for drawing and guiding the yarn.

7. Weft feeder as in claim 1, wherein the curved profiled duct forming said second device is open longitudinally towards the drum, and the aerodynamic yarn guide means in said duct consist of one or more vents formed into the outer wall of the duct.

8. Weft feeder as in claim 1, wherein the curved profiled duct forming said second device is open longitudinally towards the drum, and the aerodynamic guide means in said duct consist of protuberances formed in the intrados of the outer wall of the duct, followed by vents formed in the same wall.

9. Weft feeder as in claim 1, wherein the curved profiled duct forming said second device is closed, and said means for opening it is adapted to open said duct logitudinally downwards.

10. Method to automatically restore the continuity of weft yarn fed from a spool to a main nozzle of a fluid jet loom, through a measuring weft feeder of the type including a drum, characterized by the following steps: after having detected weft yarn breakage by means of sensors and after having stopped the loom, broken yarn is totally removed by means of a first compressed air device positioned upstream of the weft feeder; a new weft yarn is then inserted into the weft feeder; said new yarn is launched by means of a second compressed air device by which the main nozzle of the loom is fed; the new weft yarn is blocked on the weft feeder and is wound on the drum, forming again a reserve; the weft yarn is then inserted into the main nozzle and the loom is started again, the main loom nozzle being fed with the new yarn launched from said second device by means of a third compressed air device positioned downstream of the weft feeder, in which said yarn is received, is cut to size and its new end is launched to the main loom nozzle.

11. Method as in claim 10, wherein the yarn is moreover held in said third device to allow measuring on the weft feeder a yarn length equal to the distance between the yarn end in said device and the inlet of the loom shed.

12. Method as in claim 10, wherein the new yarn end is launched to the main loom nozzle by means of a pre-nozzle.

* * * * *